US009393604B2

(12) United States Patent
Abbassian et al.

(10) Patent No.: US 9,393,604 B2
(45) Date of Patent: Jul. 19, 2016

(54) HELICAL SPLINE FORMING

(71) Applicant: Magna Powertrain Inc., Concord (CA)

(72) Inventors: Bahman Abbassian, North York (CA); Lisa Christiansen, Brampton (CA)

(73) Assignee: MAGNA POWERTRAIN INC., Concord (CA)

( * ) Notice: Subject to any disclaimer, the term of this patent is extended or adjusted under 35 U.S.C. 154(b) by 297 days.

(21) Appl. No.: 13/933,711

(22) Filed: Jul. 2, 2013

(65) Prior Publication Data

US 2014/0007638 A1 Jan. 9, 2014

Related U.S. Application Data

(60) Provisional application No. 61/668,271, filed on Jul. 5, 2012.

(51) Int. Cl.

| | |
|---|---|
| ***B21C 35/00*** | (2006.01) |
| ***B21D 22/16*** | (2006.01) |
| ***B21C 35/02*** | (2006.01) |
| ***B21D 45/02*** | (2006.01) |
| ***B21D 53/28*** | (2006.01) |

(52) U.S. Cl.

CPC ..... *B21C 35/02* (2013.01); *B21D 22/16* (2013.01); *B21D 45/02* (2013.01); *B21D 53/28* (2013.01)

(58) Field of Classification Search

CPC ..... B21D 45/02; B21D 45/04; B21D 45/06; B21D 45/08; B21D 22/16; B21D 45/10; B21D 22/14; B21C 35/02

See application file for complete search history.

(56) References Cited

U.S. PATENT DOCUMENTS

| | | | | |
|---|---|---|---|---|
| 5,551,270 | A | 9/1996 | Bajraszewski et al. | |
| 5,584,202 | A | 12/1996 | Kanamaru et al. | |
| 6,253,589 | B1 * | 7/2001 | Putz | B21D 22/16 29/893.32 |
| 6,343,497 | B2 | 2/2002 | Hasegawa | |
| 7,484,394 | B2 | 2/2009 | Ogishi et al. | |
| 2004/0216505 | A1 * | 11/2004 | Knaup | 72/352 |
| 2005/0166382 | A1 * | 8/2005 | Bruggemann | 29/421.1 |
| 2007/0251283 | A1 | 11/2007 | Szuba | |
| 2008/0105021 | A1 | 5/2008 | Hodjat et al. | |
| 2009/0217725 | A1 | 9/2009 | Cripsey et al. | |
| 2009/0223270 | A1 * | 9/2009 | Akachi | 72/327 |
| 2010/0083783 | A1 | 4/2010 | Szuba et al. | |

FOREIGN PATENT DOCUMENTS

| | | | |
|---|---|---|---|
| DE | 102010060927 | A1 | 6/2012 |
| JP | H1085892 | A | 4/1998 |

OTHER PUBLICATIONS

International Search and Written Opinion for International Patent Application No. PCT/US2013/049105 Filed Jul. 2, 2013.

* cited by examiner

*Primary Examiner* — Debra Sullivan

(74) *Attorney, Agent, or Firm* — Dickinson Wright PLLC

(57) ABSTRACT

A flow-forming machine and method for forming a final part having helical splines. The flow forming machine is provided with a stripper plate for removing the final part having the helical splines therein from the mandrel and a thrust bearing is located between the stripper plate and the final part during stripping of the final part from the mandrel to allow relative motion between the stripper plate and the final part to successfully strip the final part from the mandrel without damaging and while maintaining the integrity of the helical splines of the final part. The ejector driver and mandrel may be rotated in either direction to help in successfully stripping the final part from the mandrel.

20 Claims, 5 Drawing Sheets

HELICAL SPLINE FORMING

CROSS REFERENCE TO RELATED APPLICATIONS

The instant application claims priority to U.S. Provisional Patent Application Ser. No. 61/668,271, filed Jul. 5, 2012. The entire disclosure of the above application is incorporated herein by reference.

FIELD OF INVENTION

The present disclosure relates generally to the forming of a part having an internal helical spline. More particularly, the present disclosure relates to the removal from a mandrel of a part that was formed on the mandrel and having at least one internal helical spline.

BACKGROUND OF THE INVENTION

There if a long history and developed knowledge of the use of flow forming and related processing for making parts including, cylinders and forming cylinders having internal splines typically formed along the length of the cylinder and perpendicular to the base of the mandrel. Forming and processing to form a variety of such objects, including housings, has been developed and improved over the years.

In general, flow forming offers precision, economy, and flexibility over many other methods of metal forming. The flow forming process typically involves a cylindrical work piece referred to as a "pre-form" or "blank" which can be fitted over a mandrel. In flow forming, the mandrel is a tool on which the preform can be extruded to create an internal mirror shape of the external shape of this tool. In the machine tool, both the pre-form and the mandrel are fixtured and made to rotate while a forming tool applies compression forces to the outside diameter of the pre-form. Typically, the forming tool can include three equally spaced, hydraulically-driven, CNC-controlled rollers or formers. The rollers or formers are successively applied to the pre-form to make a pre-calculated amount of wall reduction during each pass of the roller over the pre-form to form the material toward the mandrel. The material of the preform is compressed above its yield strength, and is plastically deformed onto the mandrel. The desired geometry of the work piece is achieved when the outer diameter and the wall of the preform are decreased and the available material volume is forced to flow longitudinally over the mandrel.

The finished work piece, (i.e., final part) exhibits dimensionally accurate and consistent geometry on the inside of the final part. Subsequent operations can provide the final part a variety of dimensions as desired. The existing flow forming process works well with final parts designed to function as in a clutch housing application since the splines on the inside of the housing holds clutch packs that travel axially in the clutch housing to operate the clutch. Designs such as the clutch housing having straight splines allow for removal of the final part from the mandrel with relative ease since the axis of ejection is coincident to the direction of travel of the mandrel and mandrel adaptor. Generally, it is known to eject a final part including an axially-aligned, straight spline, from the mandrel using a stripper plate. The final part is ejected by moving the mandrel toward a stripper plate which an end of the final part engages while the mandrel continues to be withdrawn from the final part. However, such a process and design has been found to work very poorly when the mandrel is designed to form a axially-offset spline, such as a helical spline, on the pre-form. In these designs, it has been attempted to eject the final part including the helical spline using the same stripper plate and then rotating the mandrel, such as by rotating the main spindle during the stripping process. Such attempts to remove a final part including helical splines have not met with success.

In one failed attempt, part ejection was believed possible by considering the dimensional accuracy of the helical splines of the final part coupled with the traditional final part ejection technique (or system) as well as final part ejection using a rotation of the central ejector counter the direction to that of the main spindle rotation.

Alternatives do exist for making a final part having a helical spline. Such alternatives including processes using traditional broaching and hobbing methods which are multistep, expensive and time consuming processes. These broaching and hobbing techniques generally require a two-part pre-form that is first formed and machined and then the two parts are combined together or integrated into the final part, such as by welding. The current annulus gear vs. the proposed. One such part is generally known wherein the final part is produced using a two-piece construction. A helical ring is broached by a helical broach in each of the two pieces and then they are welded by a laser welder to a pre-machine piece. These generally known techniques were used to form splines in parts for a very long time and flow forming replaced these techniques for parts having straight, axially aligned splines. But the current use of these generally known techniques or systems for final parts having helical splines significantly increases the final and overall costs and inefficiency in creating such a final product. Accordingly, there has long been a need for a technique or system (apparatus and process) to reduce the costs and inefficiencies associated with the broaching and hobbing processes and for forming final parts having a helical spline where the costs and efficiencies are closer to those of using a flow forming technique.

In addition, despite many varied attempts, the flow forming process fails to protect the integrity of the final part and in particular, the dimensional integrity of the helical splines. The traditional broaching and hobbing techniques remain in use but are costly and inefficient. Accordingly, there long remains a significant need for a solution to providing an apparatus and process for stripping a final part having a helical spline from a mandrel while maintaining the integrity of the final part in all aspects.

SUMMARY OF THE INVENTION

The present invention is directed to a novel technique and apparatus of system (tool and process) for a flow formed final part including helical splines that can be automatically stripped from the tool while maintaining the integrity of the final part. The technique's essential concept outlines a flow forming process for forming a final part having splines where the equally spaced grooves form a generally helix shape about a central axis, typically defined by a central axis of a shaft of the part.

The sides of the helical splines can be parallel—where the sides of the equally spaced grooves of the spline are parallel in both directions (i.e., radial and axial)—or may be involute—where the sides of the equally spaced grooves of the spline are involute (or evolvent), for example, wherein a curve is obtained from another given curve by attaching an imaginary taut string to the given curve and tracing its free end as it is wound onto that given curve such as for an involute gear.

The helical splines of the final part have significant advantages such as being able to minimize stress concentrations for a stationary joint application under high load. Another benefit of the product is that helical splines can allow for rotary and linear motion between the parts. Helical splines can ultimately reduce damage and backlash of engaging components. Flow forming the helical splines allows building a final part having one-piece construction including flow formed helical splines.

This method proved to be cost effective and efficient because the current manufacturing process requires a broach method, which is more expensive then the new system and process which solely implements a flow forming technique for the one-piece, final part including a helical spline. The process in accordance with the present invention requires fewer steps including due to the lack of either the broaching and hobbing processes and by implementing flow forming. In addition, the one-piece design used in producing the product in accordance with the present invention significantly contributes to the overall efficiency in manufacturing.

Further, the present technique will work for obtaining a final product having a far greater variety of material properties. The present technique has been proven successful with many part designs and materials including relatively lower carbon metals (including, for example, SAE 1008, SAE 1010 SAE 1012) and have been developed and proven using progressively higher carbon steels (including, for example, SAE 1026, SAE 1030 SAE 1035). The present technique has been tested and proven successful for final part ejection from the flow forming tool (mandrel) while still maintaining dimensional accuracy and integrity of the helical splines of the final part.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
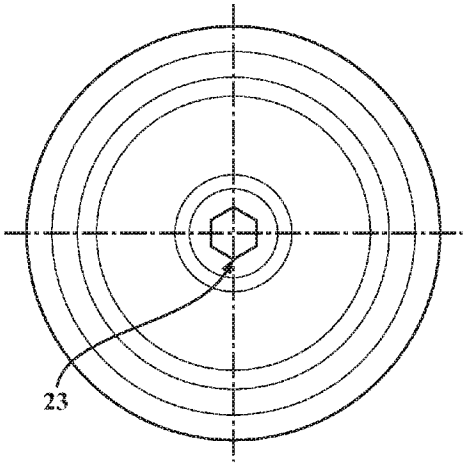
FIG. 1A is a front elevation of a matching form feature, in accordance with the present invention.

The following description of the preferred embodiment(s) is merely exemplary in nature and is in no way intended to limit the invention, its application, or uses.

Referring to FIGS. 1-4 generally, the present invention is directed to a system (apparatus and process) for flow forming a workpiece or pre-form 2 into a final part, generally shown at 4, including helical splines formed by a mandrel during a flow forming process. Flow forming the helical splines allows manufacture of a final part 4 having a one-piece construction including flow formed helical splines. In general, a flow formed final part 4 including helical splines can be automatically stripped from the apparatus while also maintaining the integrity of the final part 4. The final part 4 can have splines that are equally spaced grooves to form a generally helix shape about a central axis.

A flow-forming machine, generally show at 10, is provided with a stripper plate 12 for removing the final part 4 having the helical splines therein from the mandrel 14 and a thrust bearing 16 is located between the stripper plate 12 and the final part 4 during stripping of the final part 4 from the mandrel 14 to allow relative motion between the stripper plate 12 and the final part 4 to successfully strip the final part 4 from the mandrel 14 without damage and while maintaining the integrity of the helical splines of the final part 4. An ejector driver 32 is axially moveable and rotatable (i.e., illustrative arrows in FIG. 3) in sync with internal spline forming featuring of the mandrel in the tooling. The ejector driver 32 and the mandrel 14 may be rotated, indicated generally by rotational arrow R for illustration in a first direction, in either direction to help in successfully stripping the final part 4 from the mandrel 14.

To flow form the usable final part 4 having the helical splines therein, a plurality of rollers, generally shown at 18, engage the workpiece or pre-form 2 loaded on the mandrel 14. Most preferably, at least three rollers 18 are used. The workpiece 2 is loaded on the mandrel 14 in a generally known and standard form and is secured in place between the mandrel 14 and a tailstock assembly, generally shown at 20. The workpiece 2 is positioned using the inner diameter 22 of the central portion of the workpiece 2 as shown in FIG. 1. The workpiece is coupled to an ejector driver head, generally shown at 24, which has a matching form (such as a hexagonal shape) feature 23 for engaging the pre-form. The mandrel 14 is supported by the mandrel main adaptor 26 and the mandrel adaptor 28 and can be optionally rotated during forming of the pre-form.

The tailstock assembly 20 and the plurality of rollers 18 are retractable. The tailstock assembly 20 provides support of a tailstock head 30 connected to the tailstock assembly 20. When not in a retracted position, the tailstock head 30 engages and secures the workpiece 2 in position on the mandrel 12 and the ejector driver head 24 (see FIGS. 1-2) and contacts the ejector driver head 24.

Figure 1:
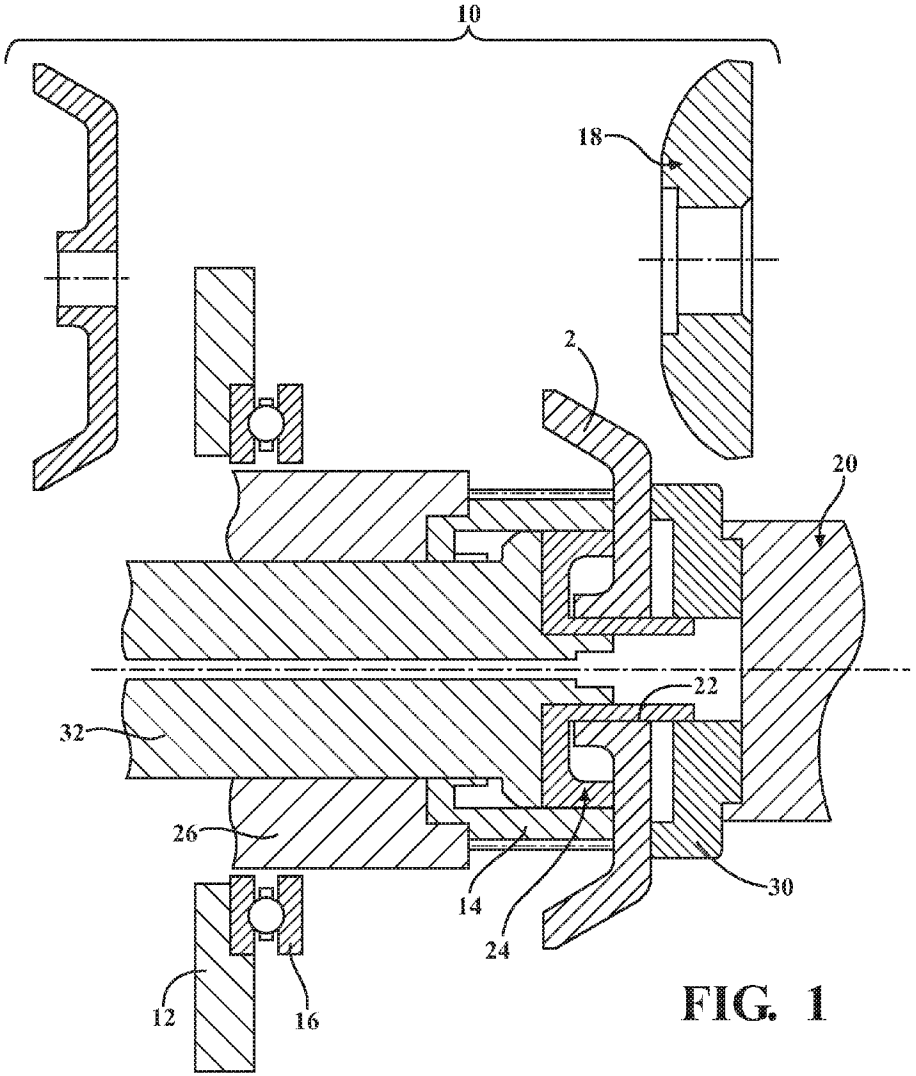
FIG. 1 is a partial, cross-sectional, graphic view of an exemplary system in accordance with the present invention wherein a pre-form part is loaded in the tool and prior to being formed on the mandrel.
Figure 2:
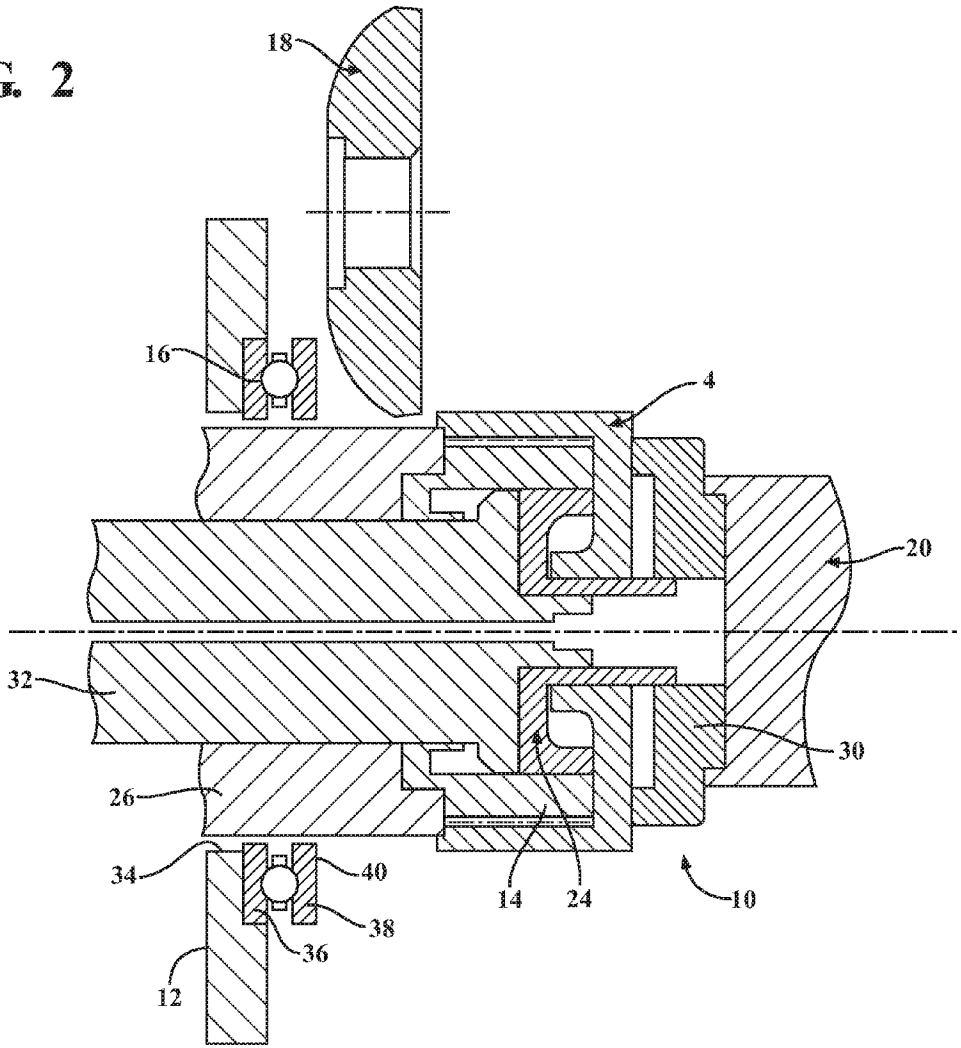
FIG. 2 is a partial, cross-sectional, graphic view and diagram of the system of FIG. 1 wherein a roller has formed the pre-form onto the mandrel to form a final part, in accordance with the present invention.
Figure 3:
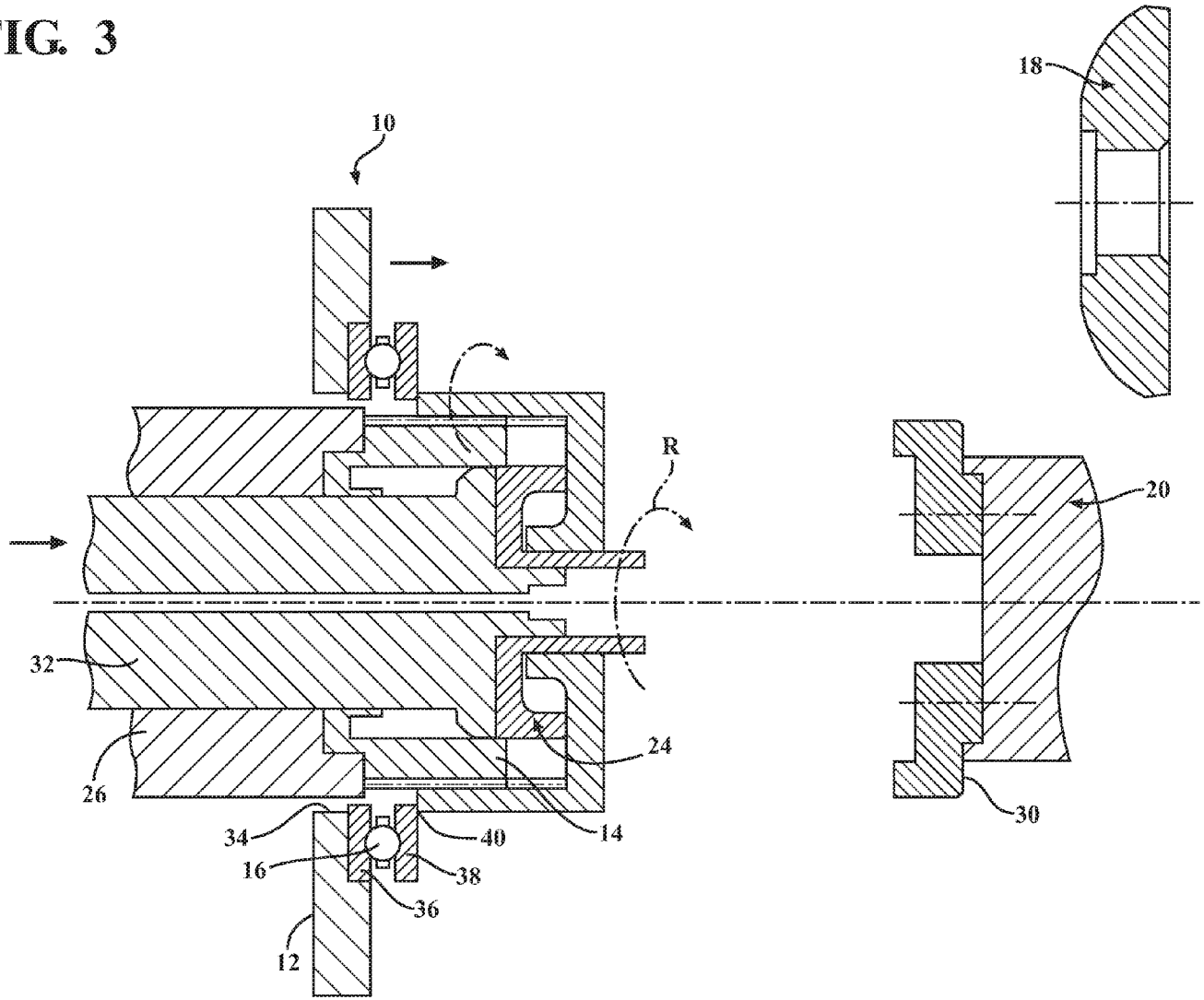
FIG. 3 is a cross-sectional, graphic view and diagram of the system of FIGS. 1-2 wherein a thrust bearing of a stripper plate engages the final part and an ejector driver is moved to begin stripping the final part from the mandrel, in accordance with the present invention.
Figure 4:
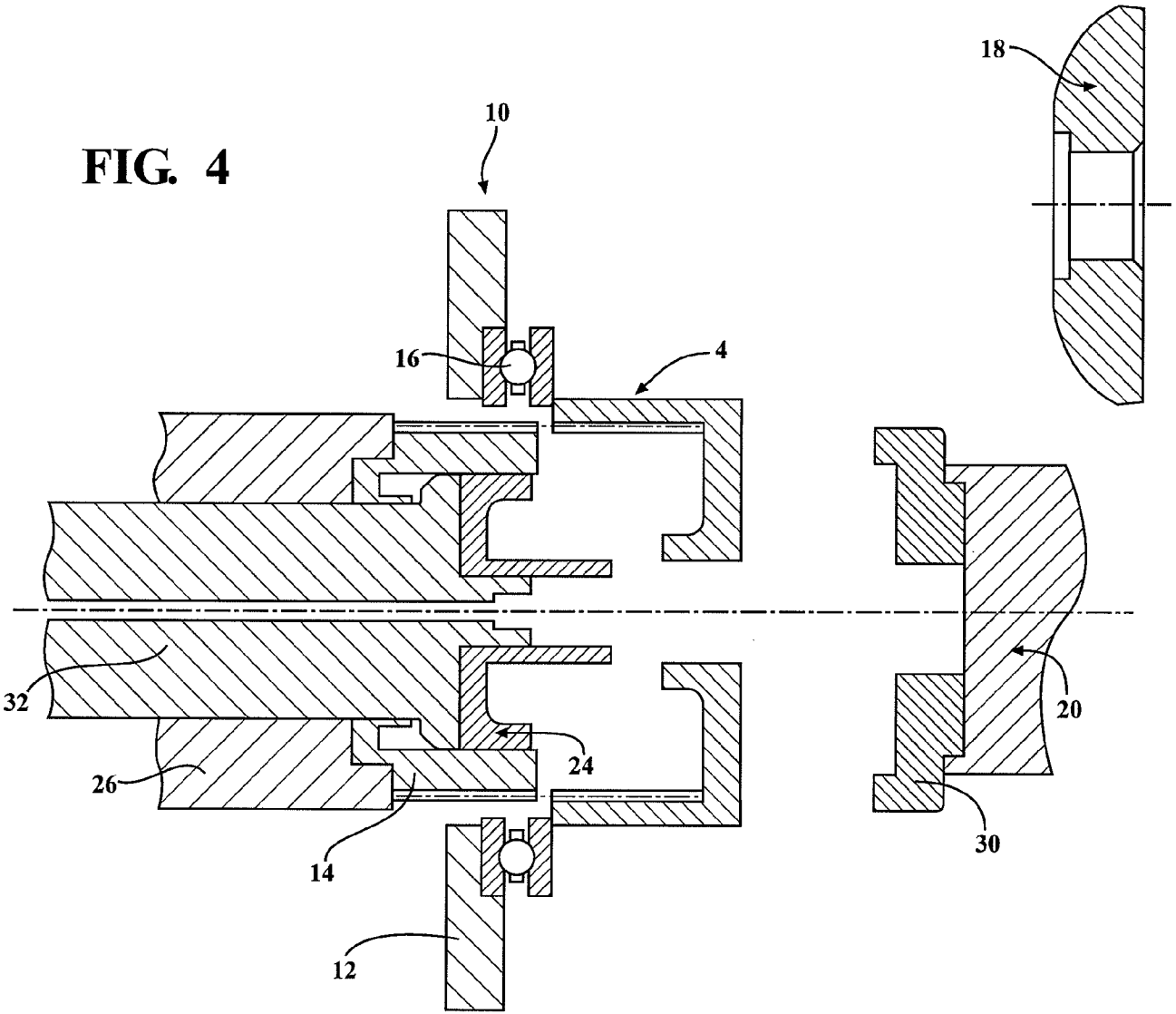
FIG. 4 is a cross-sectional, graphic view and diagram of the system of FIGS. 1-3 wherein the final part including helical splines has been completely stripped from the mandrel without any damage to the splines of the final part, in accordance with the present invention.

If the pre-form or workpiece 2 is to be rotated during forming, which is commonly the preferred approach to flow forming the pre-form, then the tailstock assembly 20 and the mandrel adaptor 28 are rotated in unison for simultaneously rotating the mandrel 14 and the pre-form 2. The plurality of rollers 18, flow forming rotatable pressure rollers 18, deform the pre-form 2 by using tremendous predetermined pressure to force the material against the mandrel 14, simultaneously axially lengthening and radially thinning the pre-form or work piece 2 toward the final part 4. The desired geometry of the workpiece is achieved when the outer diameter and the wall of the pre-form are decreased and the available material volume is forced to flow over the mandrel by one or more passes of the roller 18. (i.e., the final part 4) as best shown in FIG. 3. FIG. 1 depicts for exemplary purpose the material of the pre-form before being forced against the mandrel 14 by the rollers 18 shown in a partially retracted position. FIG. 2 depicts the pre-form 2 formed onto the mandrel 14 from the roller 18 passing at least once.

Once the final part 4 is completely flow formed on the mandrel 14, the rollers 18 are cleared and moved to a safe retracted position such that the rollers 18 are free of the final part 4, as best shown in FIG. 3, and the tailstock assembly 20 and tailstock head 30 are also retracted and free of the final part 4. The final part remains on the mandrel 14 and needs to be removed or stripped from the mandrel without damaging the helical splines formed in the final part 4 by the mandrel 14.

As should be appreciated, the tolerances of the tooling (i.e., mandrel 14) are transferred to the final part 4 during the flow forming process as is intended. However, since the final part 4 is intended to require very close tolerances, including for the helical splines, the final part 4 acquires a substantial interference fit with the mandrel 14 during the flow forming process and requires a relatively significant amount of force to remove the final part 4 from the mandrel 14. Since the helical splines match those of the mandrel 14, the interference fit is further complicated by the complicated geometry due to the helical splines. Typically, a force of approximately about 150 bar (2175 psi) is required to eject the final part 4 from the mandrel 14.

The stripper plate 12 is provided about the final part 4 and the mandrel adaptor (or spindle) 28 for creating a stop against which the final part 4 engages as the ejector driver 32 is moved or withdrawn to strip off or remove the final part 4 from the mandrel 14. Since there is a helical spline in the final part 4, the ejector driver 32 and the mandrel 14 are rotated in a direction opposite of the helical spline while the final part 4 engages the stripper plate 12 to "unthread" the final part 4 from the mandrel 14.

As shown in the Figures, the present process and system includes the thrust bearing 16 located proximal an opening 34 in the stripper plate 12. The thrust bearing 16 has a first side 36 coupled to the stripper plate 12 and a second side 38 for engaging a surface of the final part 4 during the stripping process, e.g., terminal end of the final part 4. The outer surface 40 of the second side 38 for engaging the final part 4 has a relatively roughened design for limiting and/or preventing relative movement between the second side 38 and the final part 4 during stripping of the final part 4 form the mandrel 14. The thrust bearing 16 allows the relative movement of the stripper plate 12 and the final part 4 during the stripping process which works to avoid and prevent certain movements of the final part 4 that cause damage to the helical splines. Further, it has been determined that the thrust bearing 16 may also be used.

The ejector driver 32 has a matching form feature 23 for engaging the inner diameter of the pre-form and final part to impart a rotational force in addition to axial force during removal. Because the stripper plate 12 is equipped with the thrust bearing 16 to allow the workpiece to rotate freely during the removal process from the mandrel 14, deformation of the spline or gear teeth is avoided. Damage is prevented because the helical splines of the final part 4 and the mandrel 14 completely control the relative movement and rotation of the two parts during the stripping process. Whereas, without the thrust bearing 16, the relative movement of the two pieces was attempted to be controlled by controlling the rotation of the mandrel 14 using the mandrel adaptor 28. It is contemplated that it is possible to strip a helically splined part without rotation of the ejector driver 32 and mandrel 14. Notwithstanding, with the thrust bearing 16 allowing relative movement of the stripper plate 12 and the final part 4 during the stripping process, it is now possible to rotate the mandrel 14 via the ejector driver 32 in either a clockwise or a counter-clockwise direction to strip the final part 4 with helical splines and the rotation of the ejector driver 32.

FIG. 1A is a front elevation illustrating the matching form feature 23 with a hexagonal shape operable to engage the perform 2 and allow for torque input. The matching form feature 23 can engage against the final part 4 and help impart a rotational force in addition to an axial force during removal of the final part from the mandrel. This matching form feature 23 may be used separately or in combination and together with the stripper plate 12 and thrust bearing 16 for final part removal.

Figure 5:
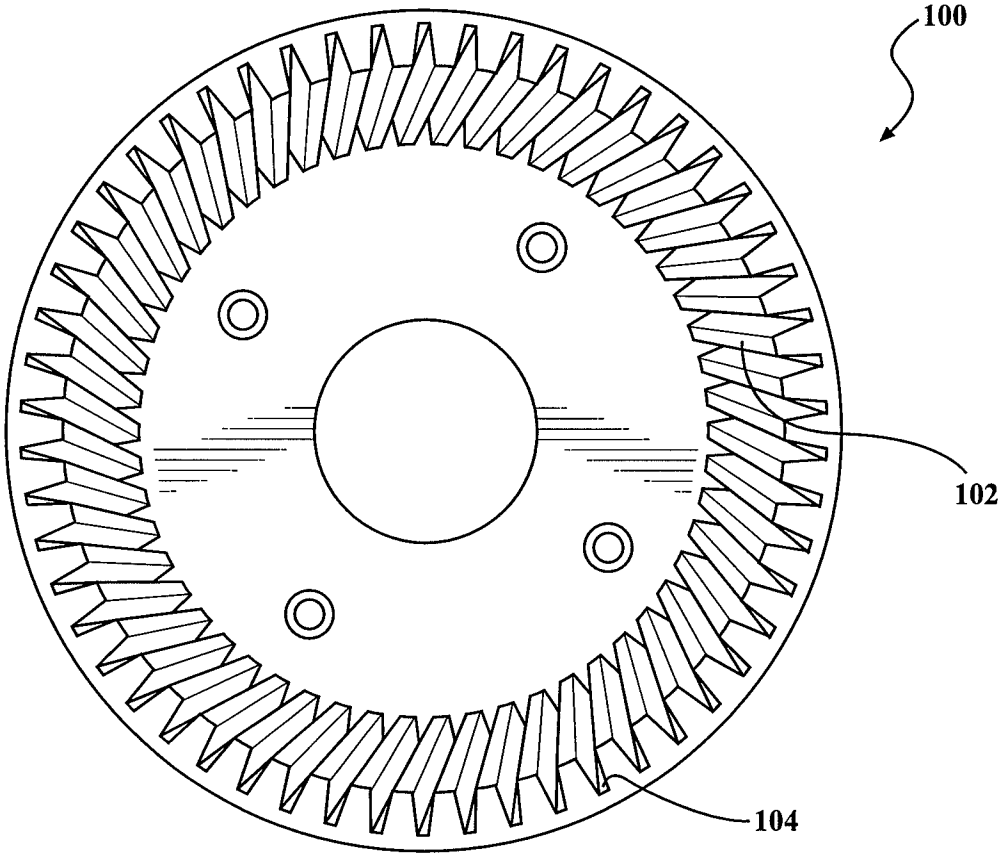
FIG. 5 is an elevation view of the final part including helical splines formed by the mandrel, in accordance with the present invention.

FIG. 5 is depicts an exemplary final part 100 having a plurality of helical splines 102 where the equally spaced plurality of grooves 104 form a generally helix shape about a central axis, typically defined by a central axis of a shaft of the part.

The sides of the helical splines 102 can be parallel—where the sides of the equally spaced grooves 104 of the spline are parallel in both directions (i.e., radial and axial)—or may be involute—where the sides of the equally spaced grooves 104 of the spline are involute (or evolvent), for example, wherein a curve is obtained from another given curve by attaching an imaginary taut string to the given curve and tracing its free end as it is wound onto that given curve such as for an involute gear.

The helical splines 102 of the final part 100 have significant advantages such as being able to minimize stress concentrations for a stationary joint application under high load. Another benefit of the product is that helical splines can allow for rotary and linear motion between the parts. Helical splines 102 can ultimately reduce damage and backlash of engaging components, and flow forming the helical splines 102 allows building a final part 100 having one-piece construction including flow formed helical splines 102.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system for removal of a flow formed final part having at least one helical spline, the system comprising:

a mandrel rotatable about an axis and having an outer shape against which a pre-form is flow formed into the final part having at least one helical spline;

a stripper plate for imparting an axial force on the final part during removal of the final part from the mandrel;

a thrust bearing located between the stripper plate and the final part for allowing relative movement between the final part and the stripper plate during removal of the part from the mandrel; and an ejector driver disposed in abutting relationship with the final part and axially movable and rotatable along the axis to impart a rotational force on the final part simultaneously with the axial force imparted by the stripper plate during the removal of the final part from the mandrel.

2. The system of claim 1, wherein the system includes a mandrel main adapter which is selectively rotatably coupled to the final part and can rotate the final part during removal of the final part from the mandrel.

3. The system of claim 2, wherein the ejector driver is rotatable in sync with the mandrel in either a clockwise or a counter-clockwise direction during removal of the final part from the mandrel.

4. The system of claim 3, wherein the ejector driver and mandrel are operably configured to rotate in a direction opposite of the helical spline while the final part operably engages the stripper plate to unthread the final part from the mandrel.

5. The system of claim 1, wherein the system further comprises a matching form feature provided on the ejector driver, the matching form feature operably shaped and configured to engage against an inner diameter of the pre-form and final part and impart the rotational force, in addition to the second axial force, during removal of the final part.

6. The system of claim 5, wherein the ejector driver includes an ejector driver head defining the matching form feature for engaging the pre-form and final part.

7. The system of claim 6 wherein the matching form feature is a hexagonal shape.

8. The system of claim 1, wherein the thrust bearing has a first side located proximal an opening to the stripper plate and coupled to the stripper plate and a second side for engaging a surface of the final part to impart the first axial force during removal from the mandrel.

9. The system of claim 8, wherein the second side of the thrust bearing has a roughened surface for preventing relative movement between the second side and the final part during removal of the final part from the mandrel.

10. The system of claim 1, wherein the final part is a one-piece final part, including a plurality of said at least one helical spline that are equally spaced, flow formed internal helical splines.

11. A process for forming and removing a final part including a plurality of helical splines comprising the steps of:

providing a thrust bearing located against a stripper plate for creating a stop for selective engagement against the final part;

loading a pre-form on a mandrel having an outer shape against which the pre-form is flow formed into the final part having a plurality of helical splines;

forming the pre-form onto the mandrel and flow forming the plurality of helical splines therein to obtain the final part;

axially moving and rotating an ejector driver to impart a rotational force on the final part; and engaging the final part with the thrust bearing simultaneously with the imparted rotational force of the ejector driver, the thrust bearing located between the stripper plate and the final part to allow relative movement while applying a predetermined sufficient force to remove the final part from the mandrel without damaging the plurality of helical splines of the final part.

12. The process of claim 11, further comprising providing an ejector driver head and an axially retractable and rotatable tailstock assembly comprising a tailstock head, said tailstock head engaging the pre-form and ejector driver head and securing the pre-form during forming.

13. The process of claim 12, further comprising providing a mandrel adaptor that is rotatable, and selectively rotating said tailstock assembly and said mandrel adaptor in unison during flow forming the pre-form for simultaneous rotating the mandrel and pre-form.

14. The process of claim 13, further comprising providing a plurality of rollers that are retractable and rotatable pressure rollers, said plurality of rollers applying a predetermined amount of pressure to force the pre-form against the mandrel and simultaneously axially and radially forming a predetermined desired geometry of the pre-form in forming the final part.

15. The process of claim 14, further comprising moving the plurality of rollers and the tailstock assembly to a retracted position while the final part remains on the mandrel prior to removal.

16. The process of claim 11, wherein the plurality of helical splines match those of the mandrel creating an interference fit and said predetermined sufficient force for removing the final part from the mandrel is about 2175 psi.

17. The process of claim 11, wherein the ejector driver is configured to rotate the mandrel in either a clockwise or a counter-clockwise direction during forming and/or removal of the final part, and said rotating of the ejector driver occurs in a direction opposite of the plurality of helical splines while the final part operably engages the stripper plate to unthread the final part from the mandrel.

18. The process of claim 11, further comprising providing a matching form feature on the ejector driver configured to engage with the final part and impart the rotational force in addition to an axial force during removing of the final part from the mandrel.

19. The process of claim 11, wherein broaching or hobbing processes are not used.

20. A process for forming and stripping a final part including a plurality of helical splines comprising the steps of:

providing a plurality of rollers;

providing a mandrel having an outer shape against which a pre-form is flow formed into the final part including a plurality of helical splines;

loading the pre-form on the mandrel;

providing an axially retractable and rotatable tailstock assembly comprising a tailstock head for engaging the pre-form and securing the pre-form during forming;

providing an ejector driver configured to rotate in sync with the mandrel in either a clockwise or a counter-clockwise direction during forming and removal of the final part;

forming the pre-form onto the mandrel and flow forming said plurality of helical splines therein to obtain the final part;

rotating the ejector driver and the mandrel in sync and in a direction opposite of the plurality of helical splines while the final part operably engages a stripper plate to unthread the final part from the mandrel; and axially moving the ejector driver during said rotating of the ejector driver and the mandrel to impart a rotational force on the final part;

engaging the final part with the stripper plate including a thrust bearing located between the stripper plate and the final part simultaneously with the imparted rotational force of the ejector driver to allow relative movement while applying a predetermined sufficient force to remove the final part from the mandrel without damaging the plurality of helical splines of the final part.

* * * * *